United States Patent [19]

Smeets

[11] Patent Number: 4,517,509

[45] Date of Patent: May 14, 1985

[54] INDUCTIVE DEVICE

[75] Inventor: Frans H. M. Smeets, Eindhoven, Netherlands

[73] Assignee: U.S. Philips Corporation, New York, N.Y.

[21] Appl. No.: 441,578

[22] Filed: Nov. 15, 1982

[30] Foreign Application Priority Data

Nov. 17, 1981 [NL] Netherlands ..... 8105195

[51] Int. Cl.[3] ..... H01F 27/24

[52] U.S. Cl. ..... 323/362; 336/87; 336/135

[58] Field of Search ..... 336/83, 87, 132, 134, 336/135; 323/362

[56] References Cited

U.S. PATENT DOCUMENTS

| | | | |
|---|---|---|---|
| 3,092,796 | 6/1963 | Maeda | 336/135 |
| 3,271,713 | 9/1966 | Oshima | 336/87 X |
| 3,309,640 | 3/1967 | Oshima | 336/135 |

FOREIGN PATENT DOCUMENTS

| | | | |
|---|---|---|---|
| 105305 | 8/1980 | Japan | 336/83 |
| 911558 | 11/1962 | United Kingdom | 336/134 |

*Primary Examiner*—Reinhard J. Eisenzopf
*Assistant Examiner*—Susan Steward
*Attorney, Agent, or Firm*—Thomas A. Briody; William J. Streeter

[57] ABSTRACT

An induction device comprises a winding support with a base having connection points. The upper side of the base carries a centering member having an exterior surface that defines either a cylindrical or conical surface co-axial with the cylindrical central portion of a core. A winding is provided about the central portion of the core. The core has a non-circumferentially or rotationally symmetrical upper flange. A ferromagnetic adjusting core in a form of a cap is arranged over the core that carries the coil, the portion of the cap facing the base having internally a shape a radial dimensions corresponding to the cylindrical or conical surface of the centering member. The cap encloses the centering member with a close fit, so that the adjusting core is rotatable about the axis of the core that carries a winding. The portion of the adjusting core adjacent to the upper flange portion of the core that carries a winding is also non-circumferentially (i.e., rotationally) symmetrical.

7 Claims, 4 Drawing Figures

INDUCTIVE DEVICE

The invention relates to an inductive device, comprising a winding support with a base which comprises connection points and on the upper side of which there is arranged a ferromagnetic coil core which comprises a cylindrical central portion about which there is arranged a winding which is conductively connected to the connection points, and a non-rotationally symmetrical upper flange portion which cooperates with a ferromagnetic adjusting core in the form of a cap which is arranged over the coil core and which is rotatable about the axis of the central portion of the coil core, said cap being non-rotationally (i.e. non-circumferentially) symmetrical at least in the vicinity of the upper portion of the coil core such that rotation of the cap relative to the upper flange portion of the core produces changes in the inductance of said winding.

BACKGROUND OF THE INVENTION

A device of this kind is known from German Offenlegungsschrift No. 28 16 042. The known device consists of a comparatively large number of separate parts which implies a time consuming and expensive assembly.

OBJECT OF THE INVENTION

The invention has for its object to provide a device of the kind set forth which consists of a minimum number of parts which can be very simply assembled.

SUMMARY OF THE INVENTION

An inductive device characterized in that on the base there is provided a centering member which comprises at least one projection from the base, its exterior defining a cylindrical or conical surface which is coaxial with the central portion of the coil core and which is enclosed with a suitable fit by the portion of the adjusting core adjacent the base and at the least the interior of which substantially corresponds as regards shape and radial dimensions to the cylindrical or conical surface defined by the centering member.

After the fitting of the winding and the connection thereof to the connection points, it is merely necessary to slide the adjusting core over the centering member in order to complete the device. The self-inductance of the device can then be adjusted by rotation of the adjusting core about the centering member. If desirable, the adjusting core can be fixed by means of an adhesive after adjustment to the desired self-inductance.

In order to form a magnetic circuit which is at least substantially closed with respect to the surroundings, a preferred embodiment in accordance with the invention is characterized in that the centering member consists of a ferromagnetic disc which forms a lower flange portion of the coil core.

In order to make the manufacture of the base itself also simple and cheap, a further preferred embodiment of the device in accordance with the invention is characterized in that the base, the disc and the coil core form one integral unit of a ferromagnetic material. This material may be, for example, ferrite or iron powder.

The number of separate parts is even further reduced in another preferred embodiment which is characterized in that on the base there are formed a number of contact feet, each of which comprises a metallized contact pad which forms a connection point, all contact pads being situated in a common plane. The metallization may consist of, for example, a paste which is applied to the contact pad on which it sets or of a metal plate or foil secured to the contact pad. Such techniques are known per se.

BRIEF DESCRIPTION OF THE DRAWING

The invention will be described in detail hereinafter with reference to the drawing wherein.

DETAILED DESCRIPTION OF THE PREFERRED EMBODIMENTS

Figure 1:
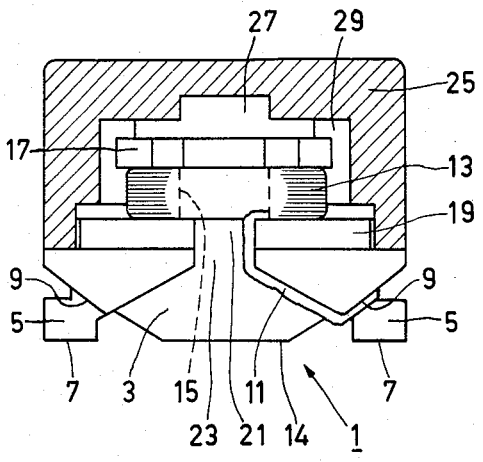
FIG. 1 is a front view of an embodiment of a device in accordance with the invention, the adjusting core being shown in a sectional view.
Figure 2:
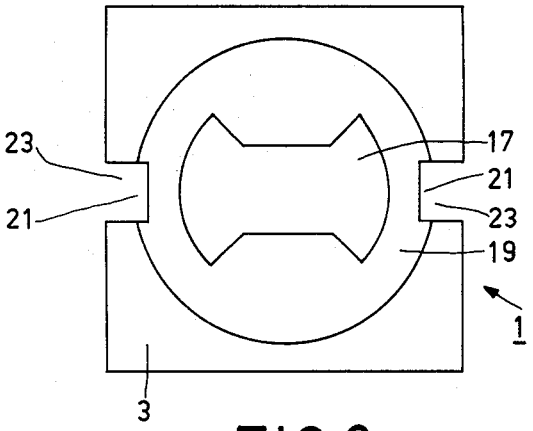
FIG. 2 is a plan view of a winding support for the device shown in FIG. 1.

The inductive device shown in FIG. 1 comprises a winding support 1 which is shown in a plan view in FIG. 2. The winding support comprises a base 3 on which there are formed four contact feet 5, on each of which there is provided a metal layer [(denoted by dots)] which extends from a contact pad 7 on the lower side of the contact foot as far as into a constriction 9 in the connection between the contact foot and the base. The constrictions 9 can serve as anchor points for lead-outs 11 of a winding 13 of, for example, copper wire, which is provided on the winding support 1. The contact pads 7 form connection points for the connection of the device to conductor tracks on a substrate, for example, a board comprising surface wiring. To this end, they are situated in a common plane. The base 3 comprises a mounting surface 14 which is situated at the same or at a slightly higher level than the contact pads 7. The device can be mounted on the substrate by way of this connection surface, for example, by means of glue.

The winding is provided about a cylindrical central portion 15 (denoted by broken lines) of a ferromagnetic coil core which also comprises a non-rotationally symmetrical upper flange portion 17 (in this case shaped as a butterfly) which bounds the winding at the upper side. The winding is bound at the lower side by a lower flange portion in the form of a disc 19 which is arranged on the base. The disc has a cylindrical shape with two cut-outs 21 which cooperate with corresponding cut-outs 23 in the base 3 in order to form passages for the lead-outs 11 of the winding 13. The disc 19 is coaxial with the central portion 15 of the coil core 15, 17. If desirable, the disc may comprise more or larger cut-outs, provided that its exterior defines a cylindrical or conical surface.

The base 3 with the contact feet 5, the disc 19 and the coil core 15, 17 are preferably formed as one integral unit of ferrite or iron powder. As a result, the manufacture is simple and cheap. It is alternatively possible to manufacture said parts separately and to assemble the parts, for example, by means of glue. The base 3, and possibly the disc 19, may in that case also be made, if desirable, of a non-ferromagnetic material, for example, a plastics. In many cases, however, preferably at least the disc 19 is made of ferromagnetic material. The magnetic lines of force are thus prevented from emerging from the lower side of the device; otherwise undesirable coupling to other parts accommodated on the substrate could occur. The disc 19 then forms a part of the coil core. Instead of contact feet 5 with contact pads 7 on the base 3, use can be made of connection pins which are secured in the base in order to form connection points.

Figure 3:
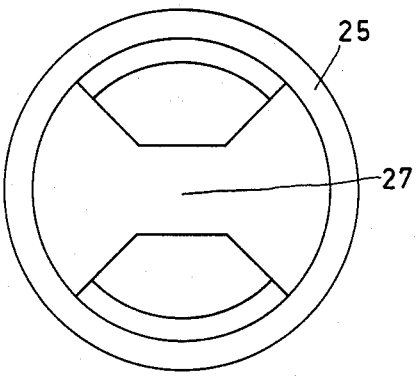
FIG. 3 is a bottom view of an adjusting core for the device shown in FIG. 1.

The device furthermore comprises an adjusting core 25 which is formed by a cap of ferromagnetic material, for example, ferrite which is arranged over the coil core 15, 17. The adjusting core (see also FIG. 3) comprises a lower portion adjacent the base 3 and which has an interior cylindrical shape with an inner diameter which substantially equals the outer diameter of the disc 19. The adjusting core 25, therefore, can be simply arranged on the base 3, the portion which faces the base then enclosing the disc 3 with a suitable fit so that the adjusting core is rotatable about the axis of the disc and hence also about the coincident axis of the central portion 15 of the coil core 15, 17. Near the upper flange portion 17 of the coil core 15, 17, the adjusting core 25 comprises a butterfly-shaped cavity 27 so that it is not rotationally symmetrical at this area. The size of the air gap 29 between the adjusting core 25 and the upper portion 17 of the coil core 15, 17, therefore, is dependent on the position of the adjusting core and can be changed by rotation of the adjusting core about the axis of the disc 19. The self-inductance of the winding 13 can thus be adjusted. In many cases it is desirable to fix the adjusting core 25 after adjustment of the self-inductance. To this end, for example, a layer of glue may be applied between the adjusting core 25 and the base 3 or the disc 19, said layer setting after the adjustment of the self-inductance.

The disc 19 serves as a (centring) member for the adjusting core 25. Obviously, such a centring member may also be formed in a different manner, for example, as a number of projections on the base which are distributed about the axis of the central portion 15 of the coil core, the outwards facing sides of said projections together forming a cylindrical or conical surface. The lower portion of the adjusting core 25 should then correspond to this cylindrical or conical surface as regards internal shape and radial dimensions. A conical surface offers the advantage that the centring of the adjusting core 25 on the centring member 19 is slightly easier than in the case of a cylindrical surface.

The described device can be readily used as an adjustable self-inductance but also, when use is made of an additional winding which surrounds the winding 13 (not shown), as a transformer or, when use is made of a capacitor, as a filter with an adjustable frequency. In order to accommodate the capacitor (or another electronic component cooperating with the winding 13), preferably a space 30 is created (see FIG. 4) between the plane in which the contact pads 7 are situated and the upper side of the base 3. A component 31 arranged therein does not project below the contact pads 7 or above the base 3, so that it does not obstruct the mounting of the device on a substrate or the adjustment of the self-inductance by means of the adjusting core 25. The connection wires 33 of the component 31 are arranged in the constrictions 9 and are conductively connected, preferably by soldering, to the lead-outs 11 of the winding 13. Another possiblity is the use of a part which comprises contact pads instead of connection wires. This part can be glued in the space 30 with its contact pads in the direct vicinity of the metallized contact feet 5. The pads are then soldered to the contact feet together with the lead-outs 11.

The upper surface of the adjusting core 25 is preferably flat, so that the device can be positioned over a substrate by means of a vacuum pipette. A vacuum pipette of this kind can also be used for the rotation of the adjusting core 25 during the adjustment of the self-inductance. Obviously, another tool may alternatively be used for this purpose, for example, a tubular tool having a non-rotationally symmetrical (for example, hexagonal) cavity which encloses the upper portion of the adjusting core 25 which should be shaped accordingly for this purpose.

Figure 4:
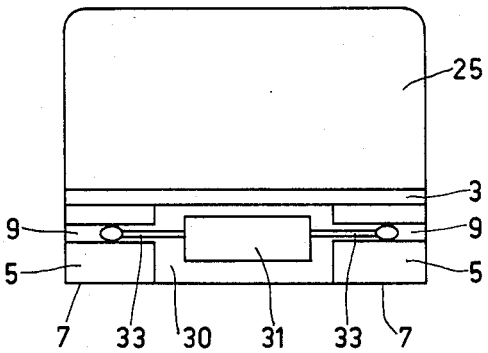
FIG. 4 is a right-hand side elevation of the device shown in FIG. 1.

The described device is very compact as appears from FIG. 4. The arrangement of the contact feet 5 with the contact pads 7 and the connection surface 14 within the lateral boundaries of the base 3 results in a block-shaped assembly without any projections. The dimensions of the device (notably the height) are not changed by rotation of the adjusting core 25. The arrangement of the adjusting core 25 around the disc 19 with a suitable fit offers adequate sealing, so that the ingress of contaminations into the space for the winding 13 is prevented to a high degree.

What is claimed is

1. In an inductive device comprising a winding support having a base with electrical connection points and a ferromagnetic core arranged on the upper side of said base, said core having a cylindrical portion adjacent said base and a noncircumferentially symmetrical upper flange portion, said device further having a winding on said cylindrical portion and a ferromagnetic adjusting cap mounted over said ferromagnetic core and cooperating with said non-circumferentially symmetrical upper flange portion of said core, said cap being rotatable about the axis of the cylindrical portion of said core, said cap further being non-circumferentially symmetrical at least in the vicinity of the upper portion of said core whereby rotation of said cap with respect to the upper flange portion of said core produces changes in the inductance of said winding; the improvement wherein said support further comprises a centering member on said base, said centering member comprising at least one projection from the base having an exterior surface defining a cylindrical or conical surface coaxial with said cylindrical portion of said core, said cap having a portion closely engaging said centering member, at least the interior portion of said cap substantially corresponding in shape and radial dimensions to said cylindrical or conical surface of said centering member.

2. A device as claimed in claim 1 wherein the centering member consists of a ferromagnetic disk which forms a lower flange portion of the cylindrical core portion.

3. A device as claimed in claim 2 wherein the base, the disk and cylindrical core portion form one integral unit of a ferromagnetic material.

4. A device as claimed in claim 3 wherein the base has formed thereon a number of contact feet, each of said feet comprising a metallized contact pad forming a connection point, all of said contact pads being situated in a common plane.

5. A device as claimed in claim 4 wherein the base is also provided with a mounting surface for mounting the device on a substrate.

6. A device as claimed in claim 4 wherein a space is provided between the plane in which the contact pads are situated and the upper side of the base, said space accommodating an electronic component conductively connected to the winding.

7. A device as claimed in claim 6 wherein the electronic component is a capacitor.

* * * * *